US010493355B2

(12) United States Patent
Reid

(10) Patent No.: US 10,493,355 B2
(45) Date of Patent: Dec. 3, 2019

(54) CARRYING SKI EQUIPMENT

(71) Applicant: Paul Reid, Chessington (GB)

(72) Inventor: Paul Reid, Chessington (GB)

( * ) Notice: Subject to any disclaimer, the term of this patent is extended or adjusted under 35 U.S.C. 154(b) by 33 days.

(21) Appl. No.: 15/328,295

(22) PCT Filed: Jul. 23, 2015

(86) PCT No.: PCT/GB2015/000217
§ 371 (c)(1),
(2) Date: Jan. 23, 2017

(87) PCT Pub. No.: WO2016/012744
PCT Pub. Date: Jan. 28, 2016

(65) Prior Publication Data

US 2018/0193719 A1 Jul. 12, 2018

(30) Foreign Application Priority Data

Jul. 23, 2014 (GB) ..... 1413029.8

(51) Int. Cl.
*A63C 11/02* (2006.01)
*A45F 5/02* (2006.01)
*A45F 3/14* (2006.01)
*A45F 5/00* (2006.01)

(52) U.S. Cl.
CPC ..... *A63C 11/025* (2013.01); *A45F 5/021* (2013.01); *A45F 3/14* (2013.01); *A45F 5/00* (2013.01); *A45F 2005/026* (2013.01); *A63C 11/02* (2013.01)

(58) Field of Classification Search
CPC . A63C 11/025; A63C 11/02; A45F 2005/026; A45F 5/021; A45F 3/14; A45F 5/00
USPC ..... 224/917
See application file for complete search history.

(56) References Cited

U.S. PATENT DOCUMENTS 2,133,883 A * 10/1938 Aubert ..... A63C 11/021 211/70.5
3,114,487 A * 12/1963 Miller ..... A63C 11/025 211/70.5
3,279,008 A * 10/1966 Wallach ..... A63C 11/021 24/16 PB (Continued)

FOREIGN PATENT DOCUMENTS

CA 2 313 301 A1 12/2001
CH 167 201 A 2/1934

(Continued)

OTHER PUBLICATIONS

International Search Report and Written Opinion Application No. PCT/GB2015/000217 dated Sep. 28, 2015, 10 pages.

(Continued)

*Primary Examiner* — Nathan J Newhouse
*Assistant Examiner* — Lester L Vanterpool
(74) *Attorney, Agent, or Firm* — Thomas|Horstemeyer, LLP

(57) ABSTRACT

An apparatus and a method for carrying skis are disclosed. The skis are encircled with a strap to form a bundle. The bundle is releasably attached to a belt or bandolier worn by a person. The strap carries an engagement member, and the belt or bandolier carrying a holder with which the engagement member is adapted releasably to engage.

19 Claims, 8 Drawing Sheets

(56) References Cited

U.S. PATENT DOCUMENTS 3,307,759 A * 3/1967 Fulton ..... A63C 11/009 294/147
3,486,672 A * 12/1969 Esopi ..... A63C 11/025 24/302
3,718,242 A * 2/1973 Larson ..... A63C 11/025 294/143
3,731,348 A * 5/1973 Luehne ..... A44B 18/00 280/814
3,780,920 A * 12/1973 Green ..... A63C 11/025 294/147
3,878,589 A * 4/1975 Schaefer ..... A45F 5/02 224/269
3,905,610 A 9/1975 Dini
3,935,997 A * 2/1976 Loje ..... D06H 3/00 235/98 C
3,947,927 A * 4/1976 Rosenthal ..... A63C 11/025 24/306
3,959,995 A * 6/1976 Fletcher ..... A63C 11/006 70/18
3,990,655 A * 11/1976 Covell ..... A63C 11/009 294/147
3,994,048 A * 11/1976 Rosenthal ..... A63C 11/025 24/306
4,002,349 A * 1/1977 Dopp ..... A63C 11/021 280/809
D245,554 S * 8/1977 Surkin ..... D6/552
4,047,726 A * 9/1977 Kokeisl ..... A63C 5/065 280/814
4,059,209 A * 11/1977 Grisel ..... A63C 11/009 211/70.5
4,171,079 A * 10/1979 Dietlein ..... A63C 11/006 280/814
4,190,182 A * 2/1980 Hickey ..... A45F 5/10 224/917
4,278,192 A * 7/1981 Sazegar ..... B60R 9/12 224/315
4,377,306 A * 3/1983 Abatecola ..... A63C 11/025 280/814
4,419,794 A * 12/1983 Horton, Jr. ..... A45F 5/02 224/197
4,460,207 A * 7/1984 Gies ..... A63C 11/025 224/917.5
4,479,674 A * 10/1984 Nordmeyer ..... A63C 11/025 294/147
4,605,335 A * 8/1986 Otrusina ..... A45F 5/02 224/269
4,681,246 A * 7/1987 Andersson ..... A63C 11/025 224/222
4,699,415 A * 10/1987 Skovajsa ..... A63C 11/025 224/257
4,718,586 A * 1/1988 Hagino ..... A45F 5/02 224/197
4,871,102 A * 10/1989 Wickersham ..... A63C 11/025 224/191
5,054,170 A * 10/1991 Otrusina ..... A45F 5/02 224/197
5,184,863 A * 2/1993 Hurson ..... A63C 11/009 294/147
5,427,291 A * 6/1995 Smith ..... A63C 11/025 224/250
5,468,036 A * 11/1995 Brown ..... A63C 11/021 224/917
5,597,102 A * 1/1997 Saarikko ..... H04B 1/3822 224/191
5,604,958 A * 2/1997 Anscher ..... A45C 7/0086 224/197
5,611,588 A * 3/1997 Mencel ..... A63C 11/02 280/814
5,620,120 A * 4/1997 Tien ..... A45F 5/02 224/194
5,730,342 A * 3/1998 Tien ..... A45F 5/02 224/197
5,839,173 A * 11/1998 Otrusina ..... A45F 5/02 24/595.1
5,850,996 A * 12/1998 Liang ..... A45F 5/02 248/221.11
5,954,379 A * 9/1999 Pikel ..... A45F 5/10 294/159
5,957,421 A * 9/1999 Barbour ..... A45F 5/02 224/197
6,038,742 A * 3/2000 Patterson ..... A45F 5/02 24/3.11
6,044,669 A * 4/2000 Levi ..... B62H 5/00 292/307 R
6,161,741 A * 12/2000 French ..... F41C 33/0227 224/192
6,575,513 B2 * 6/2003 Pikel ..... A45F 5/10 294/159
6,588,817 B1 * 7/2003 Wadeyka ..... A63C 11/023 211/70.5
6,848,605 B2 * 2/2005 Dillenberger ..... A45F 5/02 224/242
8,662,362 B1 * 3/2014 Bastian ..... H04B 1/3888 224/197
8,708,583 B2 * 4/2014 Chamberlayne ..... F16M 11/041 396/423
2002/0096545 A1 * 7/2002 Chang ..... A45F 5/02 224/271
2002/0170933 A1 * 11/2002 Martin ..... A45F 5/02 224/197
2003/0020295 A1 * 1/2003 Pikel ..... A45F 5/10 294/159
2003/0141329 A1 * 7/2003 Huang ..... A45F 5/02 224/197
2005/0258204 A1 * 11/2005 Evans ..... A45F 5/02 224/197
2007/0193007 A1 * 8/2007 Otrusina ..... A45F 5/02 24/572.1
2008/0156836 A1 * 7/2008 Wadsworth ..... A45C 11/00 224/269
2008/0209698 A1 * 9/2008 Colorado ..... A45F 5/02 24/595.1
2013/0168429 A1 * 7/2013 Pearce ..... A45F 5/021 224/676
2014/0190054 A1 * 7/2014 Ascano ..... F41C 33/007 42/71.01

FOREIGN PATENT DOCUMENTS

DE 202008014472 U1 3/2009
GB 2 428 562 A 2/2007
WO 2013057151 Al 4/2013

OTHER PUBLICATIONS

GB Combined Search and Examination Report Application No. GB1413029.8 dated Sep. 16, 2015, 6 pages.

* cited by examiner

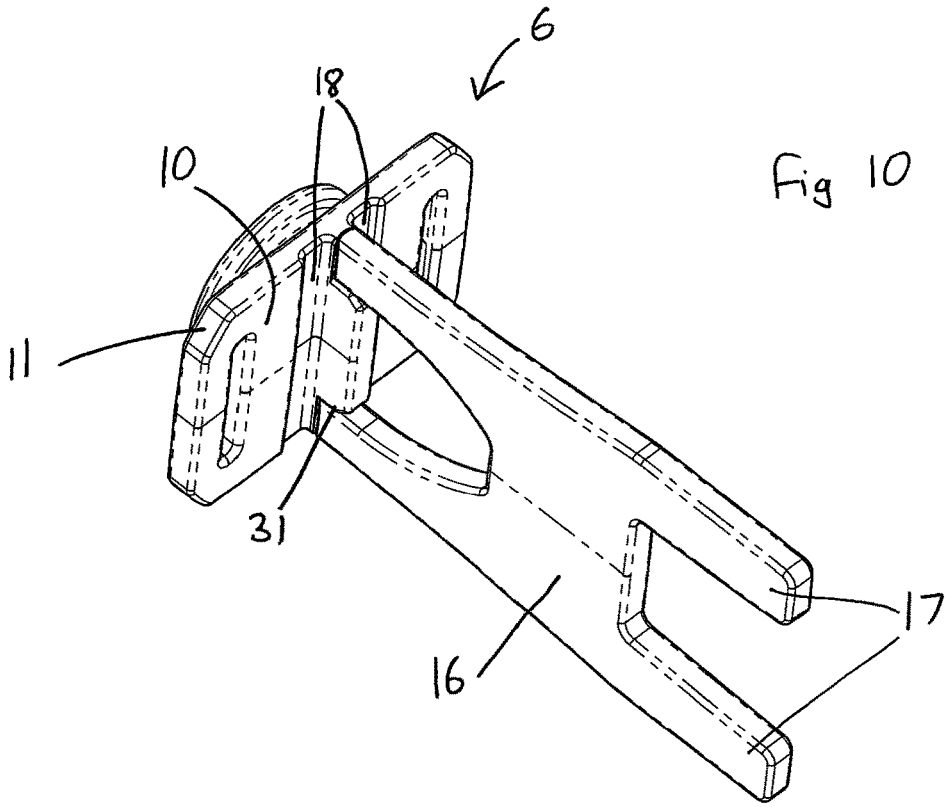
Fig 10
Fig. 11
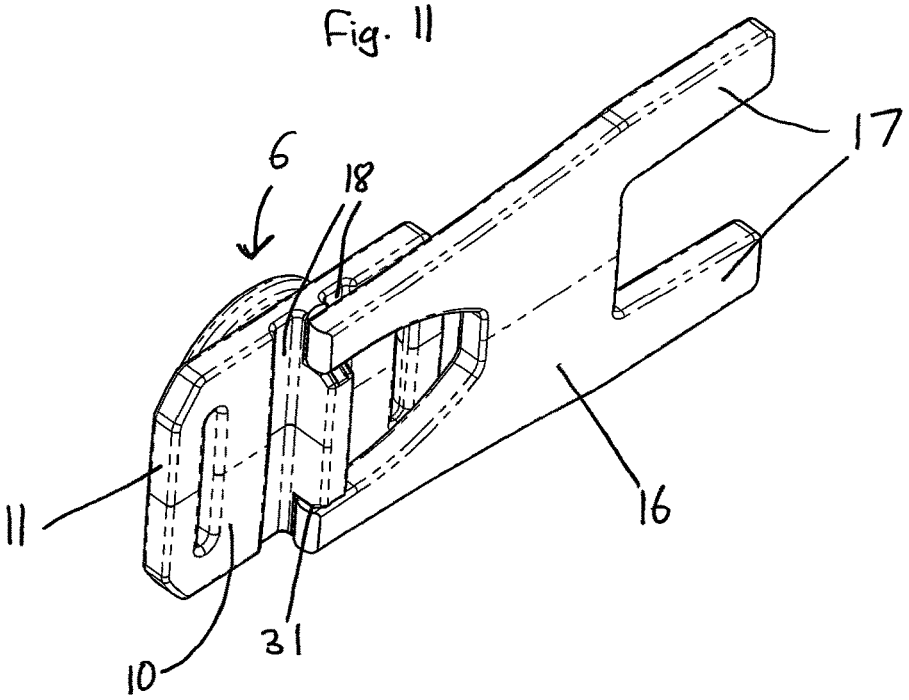

CARRYING SKI EQUIPMENT

CROSS-REFERENCE TO RELATED APPLICATION

This application is the National Stage of International Application No. PCT/GB2015/000217, filed 23 Jul. 2015, which claims the benefit of and priority to GB 1413029.8, filed 23 Jul. 2014, the entire disclosures of which are incorporated by reference in their entireties as if fully set forth herein.

FIELD OF THE DISCLOSURE

This disclosure relates to a method and apparatus for carrying ski equipment.

BACKGROUND

Skis are bulky, cumbersome and often slippery, so that carrying them by hand is not easy. Walking, often on slippery ground or up or down steps, in snow boots is not easy, and if skis have to be carried by hand at the same time, a skier has at most just one hand for balance and support.

Previous attempts to improve this situation have included bundling the skis together and pulling them along the ground, or attaching a strap to the skis and placing this strap over the user's shoulder or across their body to carry the skis.

The pull-along method is at best a partial solution, since the user must still physically carry the bundle up or down steps or into a ski-lift.

Fastening a weighty bundle of skis to a skier by the strap used to form the bundle is an awkward operation on slippery ground.

As a result, neither of these previous proposals has found favour with skiers.

As will be seen from the detailed description below of preferred arrangements, Applicant has adopted a different approach to solving this problem.

SUMMARY OF THE DISCLOSURE

In accordance with a first aspect of this disclosure, there is provided: a method for carrying skis comprising the steps of: encircling the skis with a strap to form a bundle; and releasably attaching the bundle to a belt or bandolier worn by a person, the strap carrying an engagement member, and the belt or bandolier carrying a holder with which the engagement member is adapted releasably to engage.

In accordance with a second and alternative aspect of this disclosure, there is provided an apparatus for carrying a pair of skis comprising: a strap adapted to encircle a pair of skis to form a bundle, the strap carrying an engagement member; and a belt or bandolier adapted to be worn on the person, the belt or bandolier carrying a holder with which the engagement member is adapted releasably to engage.

Preferred embodiments have one or more of the following features: The engagement member comprises a protrusion with an end profile adapted to fit into a vertically aligned slot so that it may be disengaged by simply lifting the engagement member out of the slot. The engagement member comprises a substantially flat wall portion, with a generally cylindrical protrusion on its front face, the cylindrical protrusion having a distal end formed with a circumextending ridge to provide a portion of greater width than that of the remainder of the protrusion. The holder comprises a front face, behind which the slot is located, the front face having a U-shaped cut-out, open at an upper edge of the front face, the cut-out being sized to accommodate the width of the said remainder of the protrusion with the circumextending ridge located in the slot. This construction allows the protrusion, and thus the whole of the engagement member together with the ski bundle, to pivot about the axis of the cylindrical protrusion while remaining engaged in the slot in the holder. The engagement member and the holder are moulded from a self-lubricating plastic material such as nylon. The strap comprises a first strap portion and a second strap portion, proximal portions of which are coupled to the engagement member, while distal portions of which are provided with mutual coupling means, such as a buckle or respective hook and loop portions of a hook-and-loop fastening system, for fastening the two distal end portions together about a pair of skis to form said bundle. The engagement member has a first side and a second side, the first side comprising the substantially flat wall portion with the said protrusion, and the second side being provided with a partition adapted to extend between the flat sides of a pair of skis, the distal end of the partition being bifurcated, thereby defining a space for receiving a portion of the encircling strap. The second side is provided with grooves on either side of and parallel to the partition for receiving edges of the respective skis of a pair.

The engagement member may be moulded in one piece so that the partition is solid with the rest of the engagement member. Alternatively, the partition may be hinged to the rest of the engagement member on its second side for more convenient stowage when not in use.

BRIEF DESCRIPTION OF THE DRAWINGS

Reference may now be made to the accompanying drawings, which show a preferred embodiment of apparatus for carrying a pair of skis, by way of example only, in which:—

FIG. 10 shows a perspective view from its second side of an alternative embodiment of the engagement member; and FIG. 11 shows a similar view of the alternative embodiment of engagement member when folded.

DESCRIPTION OF PREFERRED EMBODIMENTS

Figure 1:
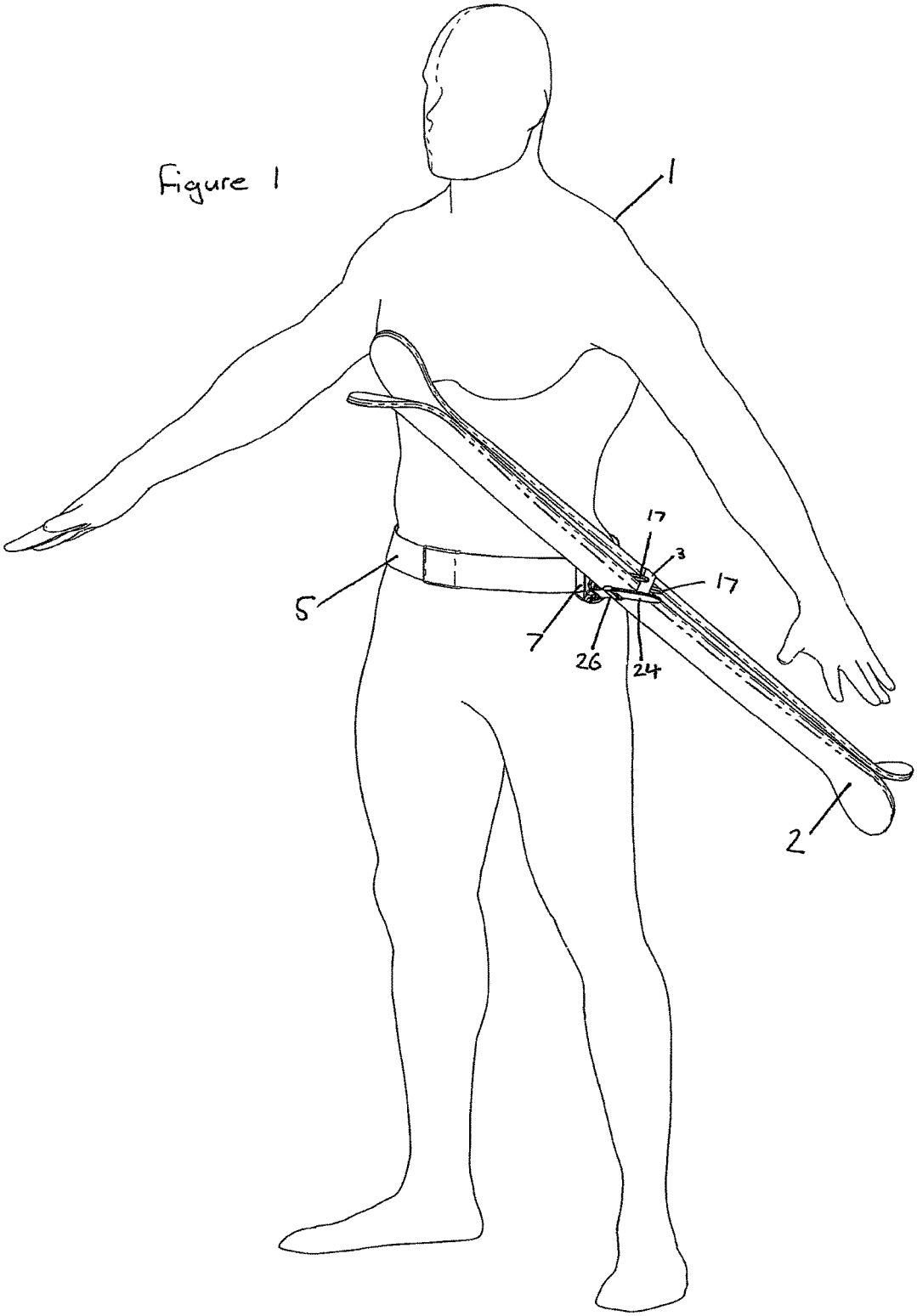
FIG. 1 shows an overview of a user carrying a pair of skis using the apparatus.

As will become clear from the following description, a user 1 may carry a pair of skis 2 by encircling the skis with a strap 3 to form a bundle 4. The bundle 4 is then releasably attached to a belt 5 worn by the user 1, as shown best in FIG. 1.

It will readily be understood that instead of a belt 5, the releasable attachment may be to a bandolier adapted to be placed over one shoulder and across the user's body.

Figure 2:
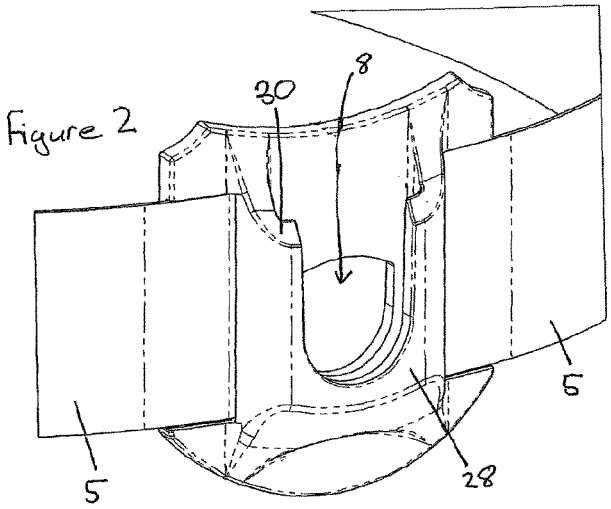
FIG. 2 shows a holder attached to a belt.
Figure 3:
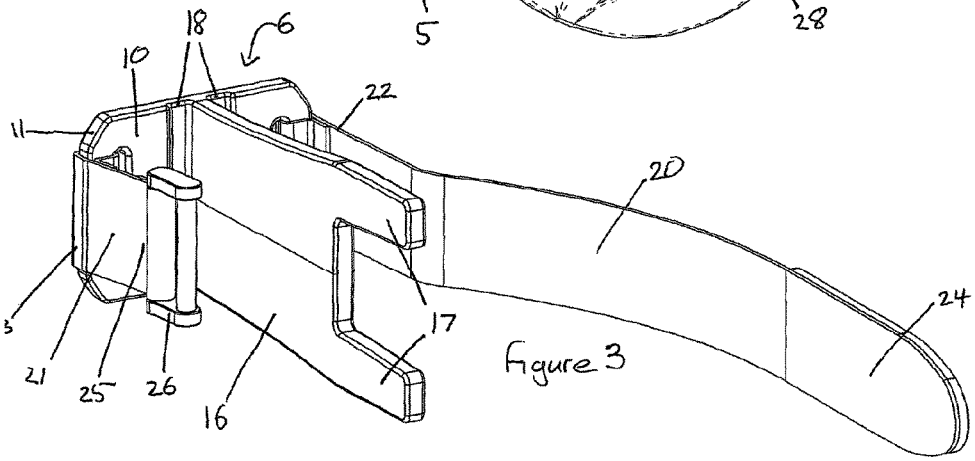
FIG. 3 shows a perspective view from its second side of an engagement member and strap.
Figure 4:
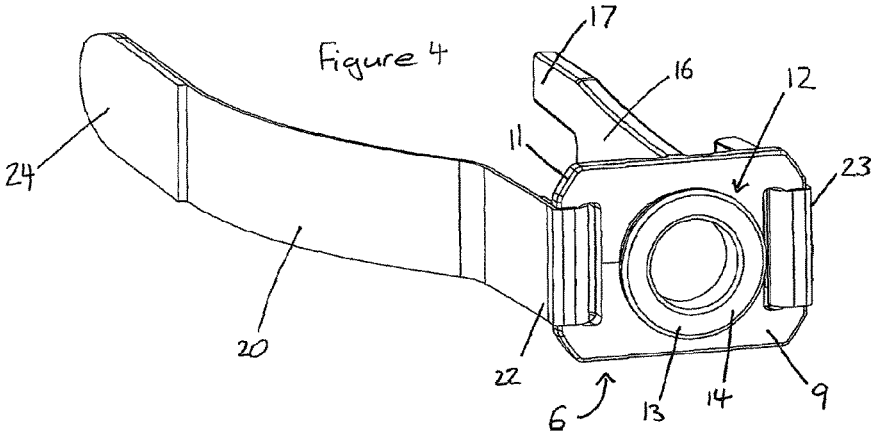
FIG. 4 shows a perspective view of the engagement member and strap of FIG. 3 from its first side.

Releasable attachment is achieved by cooperation between an engagement member 6 (FIGS. 3 and 4), and a holder 7 which is attached to belt 5, best shown in FIG. 2. In this case, the holder 7 defines a vertically aligned slot 8. As the belt 5 is already in place on the user 1 when the ski bundle 4 is to be attached to the holder 7, it will be easier for the user 1 to keep balance on slippery or uneven ground when attaching a weighty bundle of skis 4 to their person. Moreover, by employing a vertically aligned slot in the holder, a portion of the engagement member may simply be slotted vertically into the slot under gravity.

In the illustrated embodiment, the engagement member 6 has a first side 9 and a second side 10, the first side being provided with a substantially flat wall portion 11, from which a protrusion 12 extends. The distal end 13 of the protrusion 12 is adapted to fit in slot 8.

It will readily be appreciated that the distal end of the protrusion may take many forms enabling it to fit into the vertically aligned slot on the holder 7. For example an end portion of the protrusion may simply be turned through a right angle to form a hook which interfits with the slot. However, the configuration for the slot and for the distal end of the protrusion in the illustrated embodiment provides a significant advantage, as will become clear from the description below.

Figure 7:
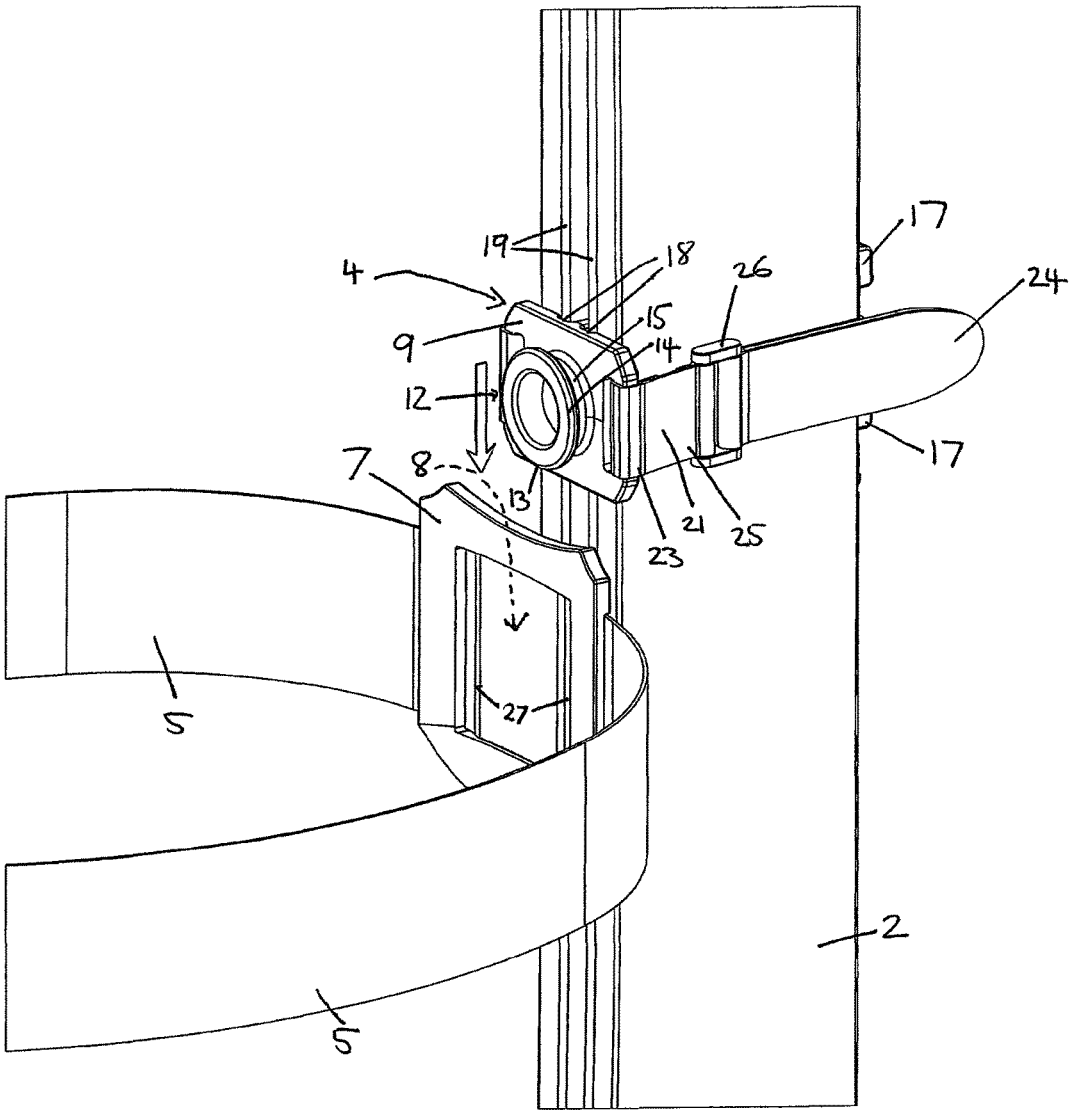
FIG. 7 shows how the engagement member in the completed bundle of FIG. 6 may be slotted into the holder of FIG. 2.
Figure 8:
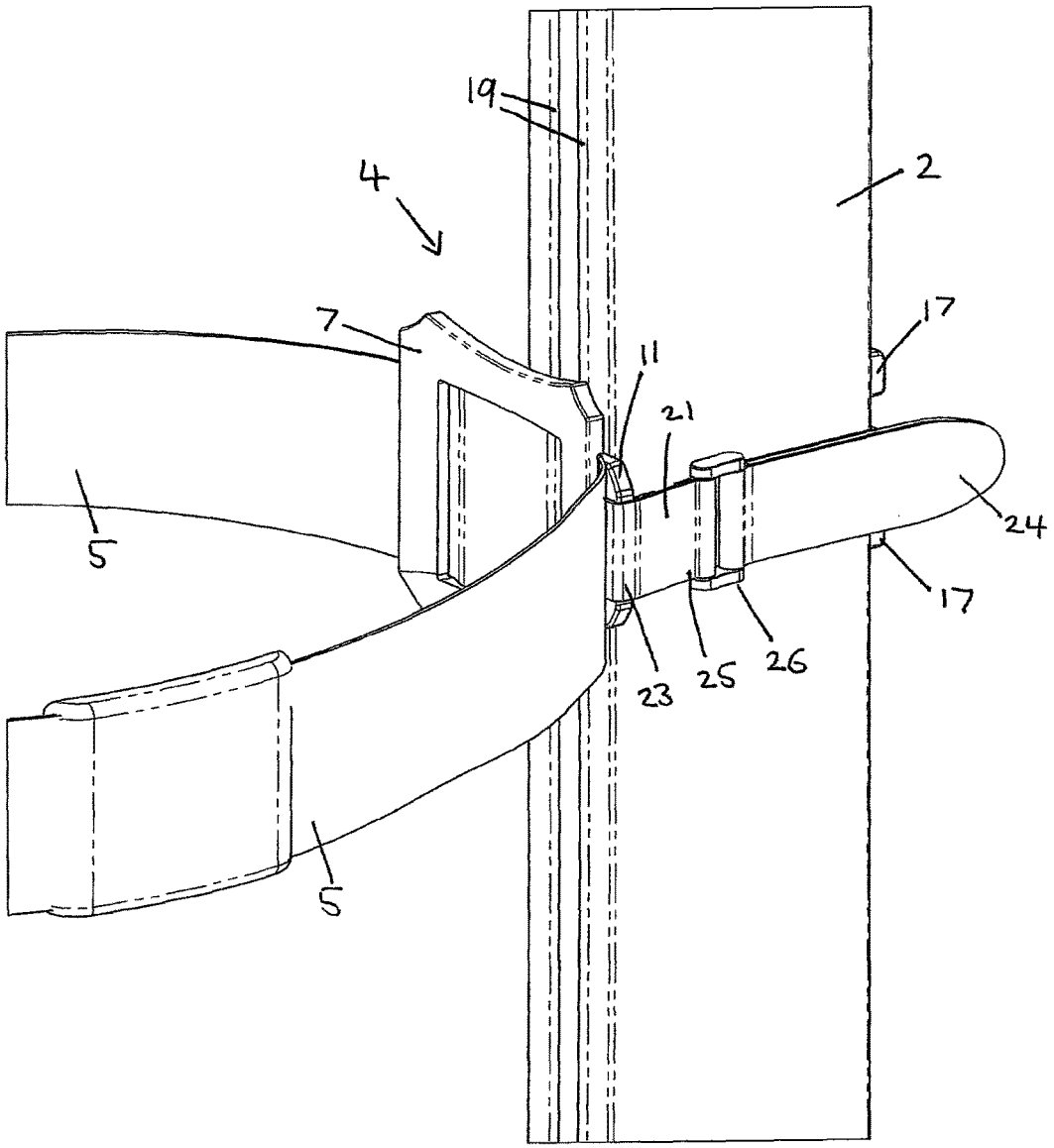
FIG. 8 shows the ski bundle attached to the belt via the engagement member and holder.

As best shown in FIG. 7, the protrusion 12 in this case takes a generally cylindrical form, with its distal end 13 formed with a circumextending ridge 14, which provides a portion of greater width than the remainder 15 of the protrusion 12. The purpose for this will become apparent from the description of the holder, below.

Figure 5:
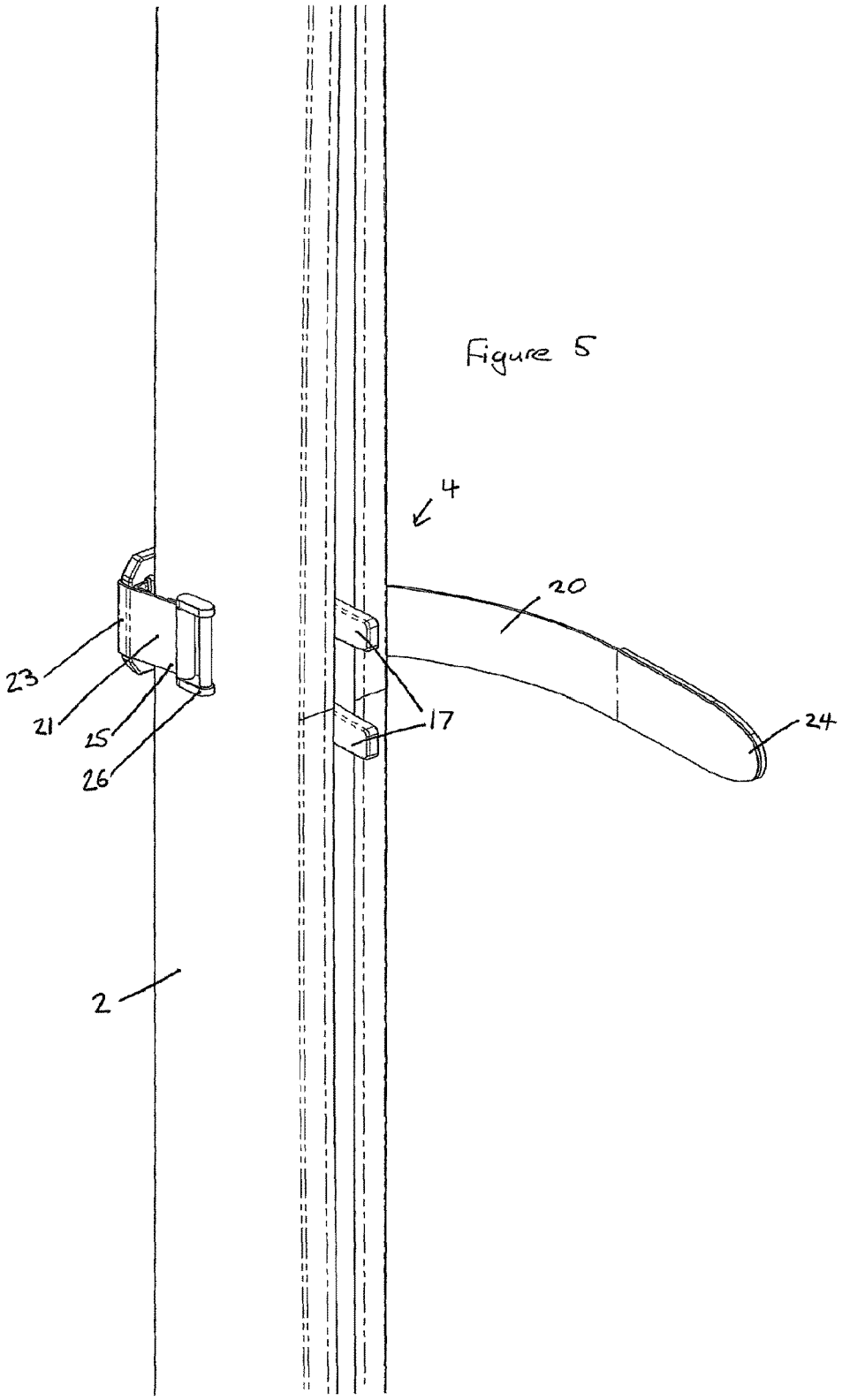
FIG. 5 shows the strap associated with the engagement member being fastened around a pair of skis to form a bundle.
Figure 6:
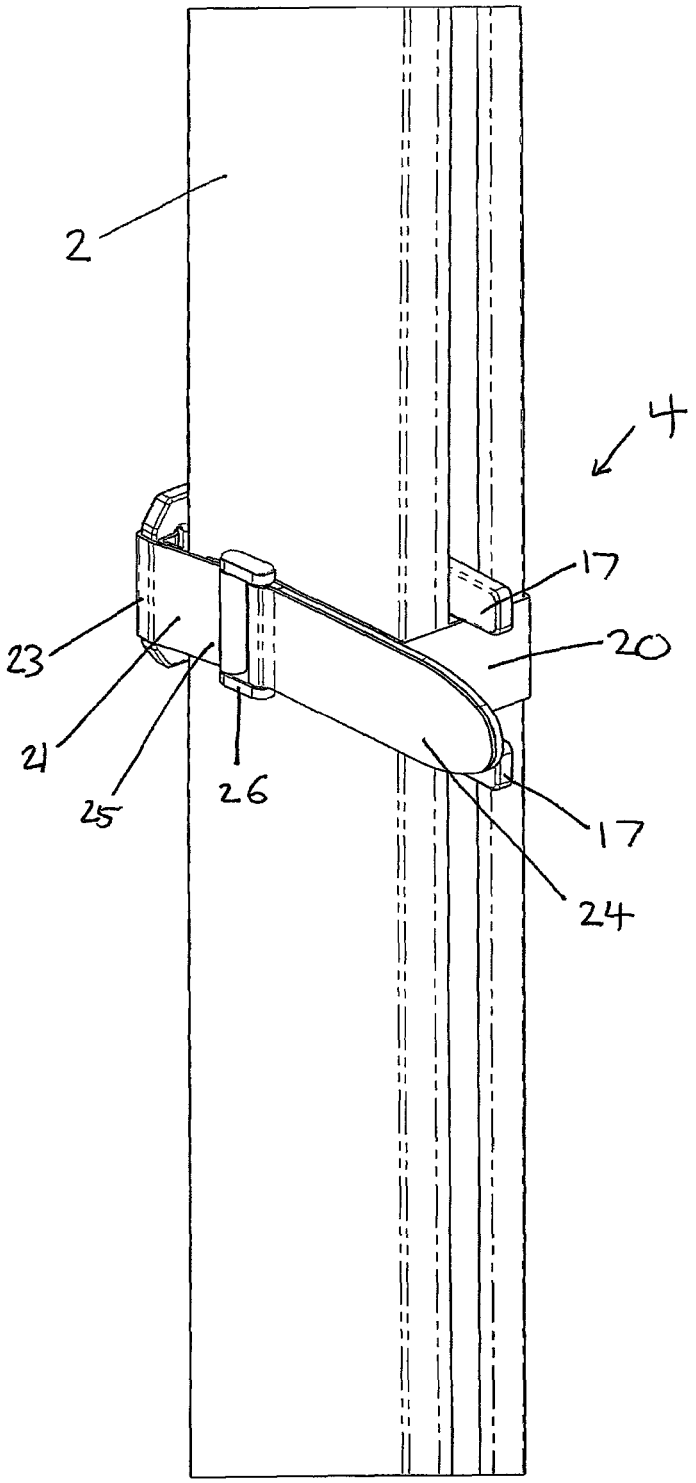
FIG. 6 shows the completed ski bundle with strap fastened.

Second side 10 of the engagement member 6 is provided with a partition 16 adapted to extend between the flat sides of a pair of skis 2 when fastening them into a bundle 4. The distal end of the partition 16 is bifurcated to allow a portion of the strap 3 to be received in the space between bifurcations 17. Second side 10 of the engagement member is also provided with grooves 18 parallel to and on either side of the partition 16 for receiving edges 19 of the respective skis of a pair. Strap 3 may carry engagement member 6 in various ways. For example, the engagement member may have a pair of openings or loops through which the belt may be passed. Alternatively, as best shown in FIG. 7, the strap 3 may comprise two strap portions 20 and 21. Proximal ends 22, 23 of the strap portions 20 and 21 may be fastened to the engagement member 6, and distal ends 24, 25 of the strap portions 20 and 21 are provided with mutual coupling means for fastening the distal ends around a pair of skis 2 to form the aforesaid bundle 4, as shown in FIGS. 5 and 6. As shown in FIG. 6, the coupling in this case is a simple slip buckle 26, although it will be readily understood that any form of buckle or clip could be substituted, as could any other suitable fastening, such as cooperating hook and loop fastening strips.

Figure 9:
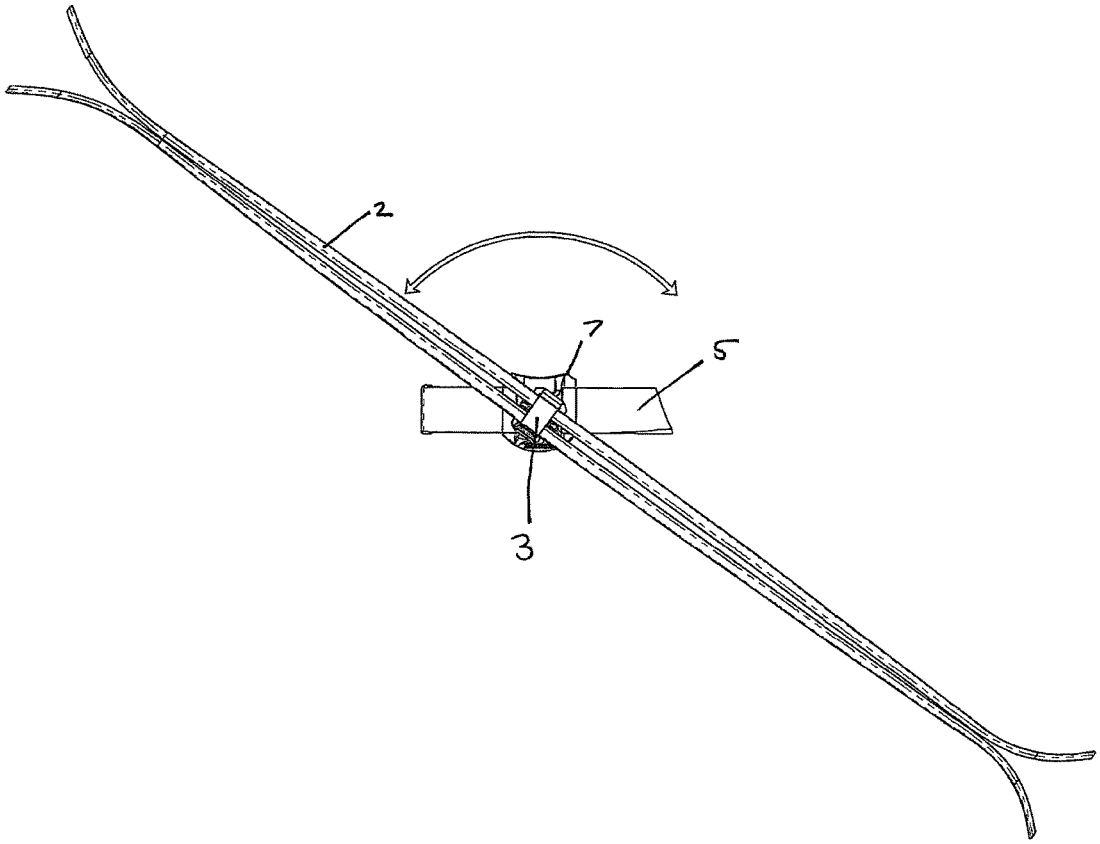
FIG. 9 shows how the ski bundle attached to the belt is enabled to pivot, while the engagement member stays engaged with the holder.

Turning back to FIG. 2, holder 7 has a pair of narrow through openings 27 allowing belt 5 to be threaded therethrough. Holder 7 comprises a front face 28, behind which the slot 8 is located. The front face 28 is here shown with a substantial U-shaped cut-out 29 and is open at an upper edge 30 of the front face 28. The cut-out 29 is sized to accommodate the width of the said remainder 15 of the protrusion 12, with the circumextending ridge 14 of protrusion 12 received in the slot 8. In effect, the edges of the U-shaped cut-out 29 are undercut to accommodate the ridge 14. This configuration allows the distal end of the protrusion to be simply slotted into the slot 8 vertically from upper edge 30 as indicated by the arrow in FIG. 7 so that the ridge is located behind the edges of the U-cut-out, and so that the entirety of the engagement member 6 and the ski bundle 4 fastened to it may pivot freely, as shown in FIG. 9, about the axis of the cylindrical protrusion 12 while the circumextending ridge 14 remains engaged in the slot 8. This pivoting action allows the user 1 to adjust the angle of the ski bundle 4 to the most comfortable position for them.

FIG. 10 shows an alternative embodiment of the engagement member 6 in which partition 16 is hingedly connected to second side 10 at 31 to allow for more convenient stowage when not in use. FIG. 11 shows this alternative embodiment of the engagement member 6 when folded.

As will be clear from FIG. 1, the skier, when carrying their skis has both hands free for balance and support, and can readily climb and descend stairs and enter a ski-lift. The skis will not slip from the bundle 4 even if the encircling strap may be slightly loose, since the ski bindings (omitted from the drawings for clarity) will tend to rest on the uppermost edge of strap 3. When the skier wishes to ski, they can simply lift the engagement member from the slot in the holder, leaving the belt and holder on their person, and unbundle the skis by loosening strap 3. The strap and engagement member 6 can simply be placed in a convenient pocket, to be brought out again when the skier has finished skiing, to reform the skis into a bundle to be releasably attached to their belt once more by simply slotting engagement member 6 into the slot 8 in the holder 7. The arrangement of FIGS. 10 and 11, which allows the partition to be folded flat against the remainder of the engagement member, makes it particularly easy to slip the engagement member into a pocket in this condition.

The invention claimed is:

1. An apparatus for carrying a pair of skis, comprising: an encircling strap adapted to encircle a pair of skis to form a bundle, the encircling strap carrying an engagement member; and a belt or bandolier adapted to be worn on the person, the belt or bandolier carrying a holder with which the engagement member is adapted releasably to engage; wherein the engagement member is provided with a partition that extends from a side of the engagement member opposite to the location of the holder when the engagement member is engaged with the holder, the partition being adapted to extend between flat sides of the pair of skis, the distal end of the partition being bifurcated, thereby defining a space for receiving a portion of the encircling strap.

2. An apparatus according to claim 1, wherein the holder comprises a slot, and the engagement member comprises a protrusion with an end profile adapted to fit into the said slot when vertically aligned, so that the engagement member may be disengaged from the holder by simply lifting the engagement member out of the slot.

3. An apparatus according to claim 2, wherein the engagement member comprises a flat wall portion, with said protrusion on its front face, the protrusion being cylindrical and having a distal end formed with a circumextending ridge to provide a portion of greater width than that of the remainder of the protrusion.

4. An apparatus according to claim 3, wherein the holder comprises a front face, behind which the said slot is located, the front face having a U-shaped cut-out, open at an upper edge of the front face, the cut-out being sized to accommodate the width of the said remainder of the said protrusion with the circumextending ridge located in the slot.

5. An apparatus according to claim 1, wherein the engagement member and the holder are moulded from a self-lubricating plastics material.

6. An apparatus according to claim 1, wherein the encircling strap comprises a first strap portion and a second strap portion, the first and second strap portions each comprising a proximal portion and a distal portion, each said proximal portion being coupled to the engagement member, and the distal portions being provided with mutual coupling means, for fastening the two distal end portions together about the pair of skis to form said bundle.

7. An apparatus according to claim 1, wherein respective grooves are provided on either side of and parallel to the partition for receiving edges of respective skis of a pair.

8. An apparatus according to claim 1, wherein the engagement member is moulded in one piece so that the partition is solid with the rest of the engagement member.

9. An apparatus according to claim 1, wherein the partition is hinged to the rest of the engagement member for more convenient stowage when not in use.

10. An apparatus according to claim 5, wherein the self-lubricating plastics material is nylon.

11. An apparatus according to claim 6, wherein the material coupling means is a buckle or a respective hook and loop portions of a hook-and-loop fastening system.

12. An apparatus according to claim 2, wherein the engagement member and the holder are moulded from a self-lubricating plastics material.

13. An apparatus according to claim 3, wherein the engagement member and the holder are moulded from a self-lubricating plastics material.

14. An apparatus according to claim 2, wherein the encircling strap comprises a first strap portion and a second strap portion, the first and second strap portions each comprising a proximal portion and a distal portion, each said proximal portion being coupled to the engagement member, and the distal portions being provided with mutual coupling means, for fastening the two distal end portions together about the pair of skis to form said bundle.

15. An apparatus according to claim 3, wherein the encircling strap comprises a first strap portion and a second strap portion, the first and second strap portions each comprising a proximal portion and a distal portion, each said proximal portion being coupled to the engagement member, and the distal portions being provided with mutual coupling means, for fastening the two distal end portions together about the pair of skis to form said bundle.

16. A method for carrying skis comprising the steps of: encircling the skis with an encircling strap to form a bundle; and releasably attaching the bundle to a belt or bandolier worn by a person, the encircling strap carrying an engagement member, and the belt or bandolier carrying a holder with which the engagement member is adapted releasably to engage; wherein the engagement member is provided with a partition that extends from a side of the engagement member opposite to the location of the holder when the engagement member is engaged with the holder, the partition being adapted to extend between flat sides of a pair of skis, the distal end of the partition being bifurcated, thereby defining a space for receiving a portion of the encircling strap.

17. A method according to claim 16, wherein the engagement member has the encircling strap, and a protrusion with an enlarged head which is adapted to engage with a vertically aligned slot in the holder with the enlarged head captured in the slot, the method comprising forming the skis into a bundle by fastening the encircling strap with the engagement member about the skis, and engaging the engagement member with the holder by sliding the protrusion of the engagement member into the slot, the bundle of skis being removable from the belt or bandolier by disengagement of the engagement member from the holder by simply lifting the engagement member out of the slot.

18. A method according to claim 16, wherein the protrusion is cylindrical, thereby allowing the protrusion, together with the remainder of the engagement member and the ski bundle, to pivot about the axis of the cylindrical protrusion while remaining engaged in the slot in the holder.

19. A method according to claim 12, wherein the protrusion is cylindrical, thereby allowing the protrusion, together with the remainder of the engagement member and the ski bundle, to pivot about the axis of the cylindrical protrusion while remaining engaged in the slot in the holder.

* * * * *